US007273839B2

(12) United States Patent
Koetzle

(10) Patent No.: US 7,273,839 B2
(45) Date of Patent: Sep. 25, 2007

(54) METHOD TO INCREASE FLASH POINTS OF FLAMMABLE SOLVENTS

(75) Inventor: A. Richard Koetzle, Rochester, NY (US)

(73) Assignee: Tarksol International L.L.C., Reno, NV (US)

( * ) Notice: Subject to any disclaimer, the term of this patent is extended or adjusted under 35 U.S.C. 154(b) by 74 days.

(21) Appl. No.: 10/968,441

(22) Filed: Oct. 20, 2004

(65) Prior Publication Data

US 2006/0081822 A1 Apr. 20, 2006

(51) Int. Cl.
*C11D 7/50* (2006.01)

(52) U.S. Cl. ..... 510/407; 510/202; 510/213

(58) Field of Classification Search ..... None
See application file for complete search history.

(56) References Cited

U.S. PATENT DOCUMENTS 4,455,308 A * 6/1984 Smolanoff ..... 514/229.2
5,393,451 A * 2/1995 Koetzle ..... 510/365
5,425,893 A * 6/1995 Stevens ..... 134/1
2002/0100185 A1* 8/2002 Sitz et al. ..... 34/427
2003/0104315 A1* 6/2003 Hendrickson et al. ..... 430/294
2005/0100823 A1* 5/2005 Hendrickson et al. ..... 430/300
2005/0109988 A1* 5/2005 Hanada et al. ..... 252/364

* cited by examiner

*Primary Examiner*—Gregory Webb
(74) *Attorney, Agent, or Firm*—Mark Levy & Associates, PLLC

(57) ABSTRACT

The present invention relates to a method to decrease the flammability of normally flammable alcohols and solvents. The additive is Alpha Terpineol, which will increase the flash point of flammable alcohols or solvents, by blending the Terpineol into the flammable solvent or alcohol. Solvents such as acetone, methanol, ethylacetate, ethanol and xylene, to name a few, increases flash points by 50° C. to 60° C., by addition of 12-14% terpineol. The said solvent can then be blended with other organic solvents to produce performance solvents, such as paint strippers with flash points greater than 140° F. and meet Federal and state Volatile Organic Compound regulations.

7 Claims, No Drawings

METHOD TO INCREASE FLASH POINTS OF FLAMMABLE SOLVENTS

BACKGROUND OF THE INVENTION

Many industrial processing cleaning compositions have been based on acetone, xylene and other ketone, alcohol, ester, aromatic hydrocarbon, aliphatic hydrocarbon, and ether solvents. As ecological concerns have risen in importance, the search for replacements for such cleaners has attained increased importance. Several requirements exist for replacement cleaners and/or solvents. One of the requirements is a concern for ozone depletion by volatile organic compounds. A solvent used historically is acetone. In 1990 2,330 million pounds were used in the United States and 110 million pounds were exported.

The greatest danger regarding acetone is that is poses a serious fire hazard. Although acetone is an excellent solvent and is relatively non-toxic, it is extremely flammable. It has a flash point of −18 C (0 F). If handled improperly, acetone may pose a dangerous fire risk. Under the United States Environmental Protection Agency's (U.S. EPA) Clean Air Act, acetone is an exempt volatile organic compound (VOC). Thus, basic problems associated with providing an effective, VOC exempt, and safe solvent has not been considered or solved using terpene alcohols to eliminate the fire hazard.

SUMMARY OF THE INVENTION

The present invention relates to a method to increase flash points of solvents, which are typically below 140 F., to over 140 F A further aspect of the invention is an acetone based cleaning composition which is admixed with a terpene alcohol, or which may be admixed with other organic solvents. An additional aspect of the invention involves the admix of solvents with acetone, a terpene alcohol, and other organic solvents to bring the blended formulation in compliance with Federal and state VOC (Volatile Organic Compound) regulations and DOT (Department of Transportation) flash point regulations.

DETAILED DESCRIPTION OF THE INVENTION

The present invention relates to increasing the flash points of aliphatic hydrocarbon, aromatic hydrocarbon, alcohol, ethers, esters and ketone solvents. Solvents which provides a safer environment to be useful in many industrial applications and processes which presently rely on low flash point solvents, such as acetone, isopropyl alcohol, ethanol, toluene, xylene, hexane, kerosene, and heptane which have flash points lower than 140 F. A solvent of particular interest is acetone, which under the United States Environmental Protection Agency's 1990 Clean Air Act Amendment has exempted acetone as a VOC (Volatile Organic Compound). Acetone is extremely flammable with a flash point of −18 C (0 F).

These improved flash point compositions comprise;

1 to 25 wt percent terpene alcohol and from 1 to 99 wt percent of a organic solvent or combination of organic solvents.

The organic solvent or combination of solvents can comprise up to 99 weight percent of the composition in total, and may be the combination of two or more different types of organic solvents. A typical combination may comprise;

1.0 to 99 weight percent organic solvent.

1.0 to 25 weight percent of terpene alcohol and specifically alpha terpineol.

The term "terpene alcohol" is understood for purposes of the present invention to encompass compounds of the formulae $C_{10}H_{18}O$ which are monocyclic, bicyclic, and acyclic alcohols, respectively. Terpene alcohols are structurally similar to terpene hydrocarbons except the structure also includes some hydroxyl functionality. They can be primary, secondary, or tertiary alcohol derivatives of monocyclic, bicyclic, or acylic terpenes as well as above. Such tertiary alcohols include terpineol which is usually sold commercially as a mixture of alpha, beta, and gamma isomers. Linalool is also a commercially available tertiary terpene alcohol. Secondary alcohols include borneol, and primary terpene alcohols include geraniol. Terpene alcohols are generally available through commercial sources.

Optionally, the solvent blended compositions of the present invention may also include a suitable solvent for a specific solvate purpose. Such solvent blends include individual solvents with a flashpoint greater than 140 F. Such solvents include the groups of ketones, alcohols, aromatic and aliphatichydrocarbons, esters, ethers, and amines Examples of organic solvents, which are employed, include 1.polyhydric alcohols, flash point 232 F consisting of ethylene glycol, diethylene glycol, 1,3 butandiol flash point 249.8 F. 2. aliphatic hydrocarbons consisting of 140 solvent, flash point 140 F., naphtha, flash point 143.6 F, 3. aromatic hydrocarbons consisting of isopar L flash point 147.2 F, 4. esters consisting of propylene carbonate flash point 269.6 F., dibasic ester flash point 212 F., 5. ethers consisting of diethylene glycol monoethyl ether flash point 204.8 F., diethylene glycol dimethyl ether flash point 145.4 F., ethylene glycol dibutyl ether flash point 185 F., and 6. amines consisting of n-methyl pyrrolidone flash point 269 F. All of the chemical components used in the present invention are commercially available.

EXAMPLES

The following examples illustrate certain aspects of the present invention. They are not intended to exemplify the full scope of the invention. In certain aspects they enable certain aspects of the invention. A method was used to determine the correct steiociometric mixture to maximize the highest point of flash. An example using xylene which has a normal flash point from between 76 F to 82 F. With certain percentage mixes of alpha terpineol the flash point is raised and the physical characteristics of the solvent are not harmed. It was observed the addition of alpha terpineol increased the flash point to a maximum and then decreased the flash point as the alpha terpineol concentration surpassed the optimum amount.

Example 1

Standard Flash Point Xylene—(76 F)

- 90.0% xylene 10.0% alpha terpineol—flash point 140 F (60 C)
- 88.5% xylene 11.5% alpha terpineol—flash point 144 F (62.2 C)
- 85.0% xylene 15.0% alpha terpineol—flash point 156 F (68.9 C)

82.5% xylene 17.5% alpha terpineol—flash point 145 F (62.8 C)

20.0% xylene 80.0% alpha terpineol—flash point 139 F (59.4 C)

The combination was clear and stable. The optimum blend contained 85% xylene and 15% alpha terpineol and increased amounts of alpha terpineol resulted in a decreased flash point.

Example 2

Standard Isopropyl Alcohol 99%

Flash point—53.1 F (11.7 C)

| Ingredient | Wt. % |
|---|---|
| Isopropyl alcohol 99% | 85.5% |
| Alpha terpineol | 14.5% |
| | 100.0% |

The combination was clear and stable. When tested it exhibited a flash point of 145.4 F (63.0 C) using a Pensky-Martens Closed Cup Flash Point procedure Example 3

Standard Methanol

Flash point—51.8 F (11 C)

| Ingredient | Wt. % |
|---|---|
| Methanol | 86.0% |
| Alpha terpineol | 14.0% |
| | 100.0% |

The combination was clear and stable. When tested it exhibited a flash point of 141.6 F (62.0 C) using a Pensky-Martens Closed Cup Flash Point procedure.

Example 4

Standard Acetone

Flash point—0 F (−18.0 C)

| Ingredient | Wt % |
|---|---|
| Acetone | 82.0% |
| Alpha terpineol | 18.0% |
| | 100.0% |

The combination was clear and stable. When tested it exhibited a flash point of 143.6 F (62.0 C) using a Pensky-Martens Closed Cup Flash Point procedure.

Example 5

Standard Ethyl Acetate

Flash point—30.2 F (−1.0 C)

| Ingredient | Wt % |
|---|---|
| Ethyl acetate | 83.0% |
| Alpha terpineol | 17.0% |
| | 100.0% |

The combination was clear and stable. When tested it exhibited a flash point of 141.8 F (61.0 C) using Pensky-Martens Closed Cup Flash Point procedure.

Example 6

Standard Ethanol

Flash point—55.4 F (13.0 C)

| Ingredient | Wt % |
|---|---|
| Ethanol | 86.0% |
| Alpha terpineol | 14.0% |
| | 100.0% |

The combination was clear and stable. When tested it exhibited a flash point of 145.4 F (63.6 C) using Pensky-Martins Closed Cup Flash Point procedure.

The preceding examples 1-6 were directed principally to increase the flashpoint of organic solvents to over 140 F. These compositions are environmentally and significantly safer for handling and storage over the individual organic solvent.

The solvent system of this invention can be used as is, may be blended with other organic solvents to produce an environmentally and safer performance solvent system. Acetone has a flashpoint of 0 F (−18.0 C) by itself. In example 4 the acetone mixed at 82.0 wt percent with 18.9 wt percent of alpha terpineol, the resulting flashpoint is increased to 141.6 F (62.0 C). The acetone and alpha terpineol mixture can be mixed with other environmentally correct solvents with flash points over 140 F resulting in a safer solvent designed for a specific application, such as, a paint stripper. The acetone portion of the preferred mixture is an exempt volatile organic compound and therefore provides a solvent system that meets Federal and state regulations Example 7

| Ingredient | Wt. % |
|---|---|
| N-Methyl Pyrrlidone | 29.0% |
| Dibasic Ester | 29.0% |
| Acetone | 42.0% |
| | 100.0% |

The combination was clear and stable. When tested it exhibited a flash point of −4.2 C using Pensky-Martens Closed Cup Flash Point Tester.

Another sample was made adding alpha terpineol to the formulation, as exhibited in Example 8

Example 8

| Ingredient | Wt. % |
|---|---|
| N-Methyl Pyrrolidone | 24.0% |
| Dibasic Ester | 24.0% |
| Alpha Terpineol | 10.0% |
| Acetone | 42.0% |
| | 100.0% |

The composition of example 8 had a flashpoint of 141.6 F (62.0 C) using Pensky-Martens Closed Cup Flashpoint Tester. By the addition of 10% alpha terpineol, the flash point of the mixture in Example 7 was increased by 64.2 C. The composition of example 8, contains 0% Volatile Organic Compound content based on USEPA Regulations that a component or mixture having a vapor pressure less than 0.1 mm Hg at 20 C, exempts that mixture-from the VOC content limit making the composition compliant with Federal and state VOC regulations. N-methyl pyrrolidone, dibasic ester, and alpha terpineol exhibit vapor pressures less than 0.1 mm Hg at 20 C and acetone is VOC exempt under Federal Regulations. The increased flash point complies with DOT flammability regulations.

Alpha terpineol is a commercially available terpene alcohol sold by Millennium Chemical. Alpha terpineol can contain alpha terpene, among other terpene hydrocarbons, and exhibits a flashpoint of between 180 F and 200 F, depending upon the volatile impurities present.

In the event a solvent formulation is used, such as example 8, then I prefer that the solvents, other than the low flash point solvent blended with alpha terpineol, likewise have a relativity high flash point. According to the Condensed Chemical Dictionary 1956 edition, Reinhold Publishing Company, n-methyl pyrrolidone has a flash point of 204 F and dibasic ester has a flash point of 212 F.

Those skilled in the art will recognize that the alpha terpineol/solvent blend may themselves be used to remove grease and other contaminants from various materials, such as steel, aluminum, and other substrates. The terpene alcohol blend with other solvents may be contained within a tank into which the material to be cleaned is placed. Heating of the terpene alcohol/solvent blend may not be needed, depending upon the application, although because of the high flash point, heating may be useful. Should the terpene alcohol/solvent blend become too concentrated with contaminates, then the bath may be disposed of or the contaminate separated from the alcohol/solvent blend by various means, including membrane filtration.

While this invention has been described as having a preferred design, it is understood that it is capable of further modifications, uses and/or adaptations of the invention, following the general principle of the invention and including such departures from the present disclosure has come within known or customary practice in the art to which the invention pertains, and as may be applied to the central features hereinbefore set forth, and fall within the scope of the invention of the limits of the appended claims.

I claim:

1. A solvent system consisting essentially of:

a) a first organic solvent selected from the group ketones, alcohols, aromatic hydrocarbons, aliphatic hydrocarbons, ethers and esters., wherein said first solvent has a flash point less than 140° F.; and b) a second organic solvent comprising a terpene alcohol in an amount of at least about 5 volume percent of the total solvent system, and less than about 45 volume percent of the total solvent system, and sufficient to increase the flash point for the solvent system to over 140° F. when tested in accordance with ASTM D-93;

wherein said first organic solvent is acetone present at a concentration of about 82 weight percent and wherein said second organic solvent is present at a concentration of about 18 weight percent of the total solvent system, such that said solvent system has a flash point greater than 140° F.

2. A solvent system consisting essentially of:

a) a first organic acetone solvent; and b) a second organic solvent consisting of a terpene alcohol in an amount which is at least about 5 volume percent of the total solvent system, and less than about 45 volume percent of the total solvent system, and sufficient to increase the flash point for the solvent system to over 140° F. when tested in accordance of ASTM D-93; and c) a third organic solvent with a flash point less than about 140° F., said third organic solvent being a non-terpene alcohol.

3. The solvent system of claim 2 wherein said second solvent comprises alpha terpineol.

4. A solvent system comprising:

a) a first organic acetone solvent present at a concentration of from about 42 weight percent to about 95 weight percent of the total solvent system;

b) a second organic solvent consisting of a terpene alcohol present in an amount of at least from about 5 volume percent of the total solvent system, and less than about 20 volume percent of the total solvent system, and sufficient to increase the flash point for the solvent system to over 140° F. when tested in accordance with ASTM D-93; and c) a third organic solvent with a flash point less than 140° F. selected from the group consisting of ketones, alcohols, aromatic hydrocarbons, aliphatic hydrocarbons, ethers, and esters.

5. The solvent system of claim 4, wherein said second organic solvent comprises alpha terpineol.

6. A cleaning composition comprising:

a) 5 to 45 weight percent alpha terpineol, wherein said alpha terpineol is sufficient to increase the flash point of said cleaning composition to at least 140° F.;

b) 1 to 35 weight percent of a first organic solvent with a flash point less than 140° F., wherein said first organic solvent comprises acetone; and c) 5 to 90 weight percent of a second organic solvent with a flash point greater than 140° F.

7. The cleaning composition of claim 6 wherein said second organic solvent comprises an organic material selected from the group of ketones, alcohols, aromatic hydrocarbons, ethers, and esters with a flash point greater than 140° F.

* * * * *